US006518523B1

(12) United States Patent
Chou

(10) Patent No.: US 6,518,523 B1
(45) Date of Patent: Feb. 11, 2003

(54) TILT SWITCH

(76) Inventor: Tien-Ming Chou, No. 41, San-Hsi 5th St., Pei Dist., Taichung City (TW)

( * ) Notice: Subject to any disclaimer, the term of this patent is extended or adjusted under 35 U.S.C. 154(b) by 0 days.

(21) Appl. No.: 10/008,554

(22) Filed: Nov. 13, 2001

(51) Int. Cl.[7] ..... H01H 35/14

(52) U.S. Cl. ..... 200/61.52; 200/61.45 R; 200/61.51; 340/566; 340/546

(58) Field of Search ..... 200/61.52, 61.45 R, 200/61.46, 61.48, 61.47, 61.51; 340/566, 429, 689, 545.1, 546, 547

(56) References Cited

U.S. PATENT DOCUMENTS 3,769,472 A * 10/1973 Bell et al. ..... 200/61.45 R
3,927,286 A * 12/1975 Fohl ..... 200/61.45 R
5,597,066 A * 1/1997 Burmester ..... 200/292
5,808,254 A * 9/1998 Wu ..... 200/61.45 R
6,005,205 A * 12/1999 Chou ..... 200/61.45 M
6,028,275 A * 2/2000 Jou ..... 200/61.52
6,087,936 A * 7/2000 Woods ..... 340/429

* cited by examiner

*Primary Examiner*—Lincoln Donovan
*Assistant Examiner*—Kyung S. Lee
(74) *Attorney, Agent, or Firm*—Whyte Hirschboeck Dudak SC

(57) ABSTRACT

A tilt switch includes an insulating housing with an inner peripheral wall surface which confines an accommodation chamber for rollably receiving an electrically conductive ball. First and second electric contact terminals have upper end portions inserted into the chamber and having contact surfaces to contact the ball when the housing is in an upright position so as to make an electrical connection therebetween. The inner peripheral wall surface includes a shoulder segment for facilitating the rolling movement of the ball to break the electrical connection when the housing is tilted to a predetermined angle.

5 Claims, 8 Drawing Sheets

TILT SWITCH

BACKGROUND OF THE INVENTION

1. Field of the Invention

This invention relates to a tilt switch, more particularly to a tilt switch which is adapted to be mounted on a support and which has an electrically conductive ball rollable to make or break an electrical connection between two electric contact terminals.

2. Description of the Related Art

Referring to FIGS. 1 and 2, a conventional tilt switch 10 is shown to include a rectangular insulating housing 11 with an accommodation chamber therein for receiving rollably an electrically conductive ball 12. Two pairs of first and second electric contact terminals 13 are press-fitted to a bottom plug 14, and have upper tip ends 131 extending into the accommodation chamber of the housing 11 when the bottom plug 14 is secured to a bottom opening 111 of the housing 11 by virtue of engagement between protrusions 112 and recesses 142. A seal member 114 is disposed to seal a clearance 113 between the housing 11 and the bottom plug 14. Lower tip ends 132 of the terminals 13 are soldered on an electric contact member of a support (not shown). When the tilt switch 10 is mounted on the support, which stands on a horizontal plane 20, the ball 12 contacts the upper tip ends 131 to make an electrical connection between the first and second electric contact terminals 13. Once the support is tilted, the ball 12 will roll away from the terminals 13 to break the electrical connection.

The housing 11 has an inner peripheral wall surface 115 extending uprightly to confine the elongated accommodating chamber such that the ball 12 is rollable thereon. It is noted that the movement of the ball 12 is somewhat difficult away from the terminals 13 in the state that the housing 11 is not tilted down completely, thereby resulting in lack of safety during use.

SUMMARY OF THE INVENTION

The object of the present invention is to provide a tilt switch which can provide adequate protection to an electrical appliance.

According to this invention, the tilt switch includes an insulating housing adapted to be mounted on a support in an upright direction. The housing has an inner bottom wall surface, and an inner peripheral wall surface which extends upwardly from a periphery of the inner bottom wall surface and which confines an accommodating chamber therein. The inner peripheral wall surface includes a lower segment which is proximate to the periphery of the inner bottom wall surface and which defines a first diameter, an upper segment which is disposed opposite to the lower segment in the upright direction and which defines a second diameter larger than the first diameter, and an annular shoulder segment which extends between and which interconnects the upper and lower segments so as to define an annular juncture between the lower and shoulder segments. First and second electric contact terminals are secured in the housing at middle portions thereof. Each of the first and second electric contact terminals has an upper end portion which extends upwardly from the middle portion into the accommodation chamber through the inner bottom wall surface to form a contact surface spaced apart from the bottom wall surface, and a lower end portion which extends downwardly from the middle portion and outwardly of the housing to be adapted to establish electrical connection with the support. The contact surfaces of the first and second electric contact terminals are spaced apart from each other in a transverse direction relative to the upright direction. An electrically conductive ball is received rollably in the accommodation chamber, and is of such a dimension as to contact the contact surfaces when the housing stands in an upright position, thereby making an electrical connection between the first and second electric contact terminals. The ball defines a first horizontal plane at which a center of the ball is located. The annular juncture is located at a second horizontal plane lower than the first horizontal plane such that once the housing is tilted from an upright position, the ball will move over the annular juncture to the shoulder segment so as to break the electrical connection between the first and second electric contact terminals.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
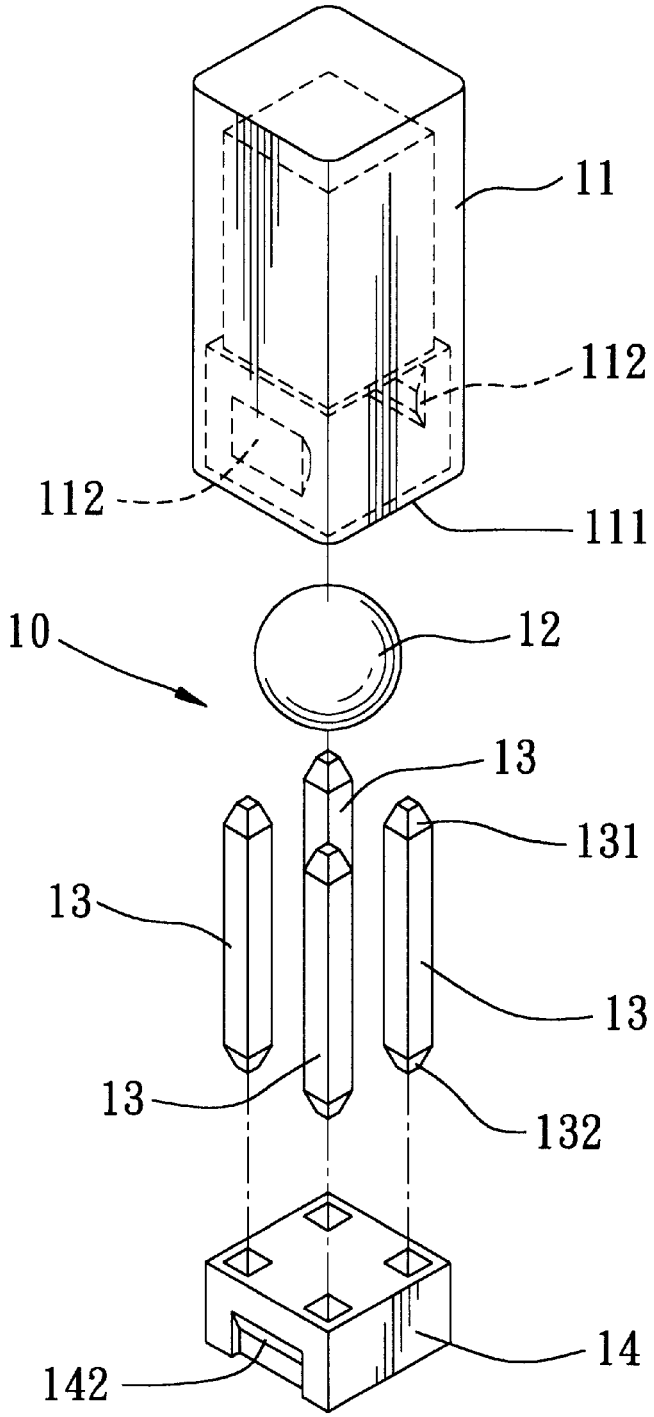
FIG. 1 PRIOR ART
FIG. 1 is an exploded perspective view of a conventional tilt switch.
Figure 2:
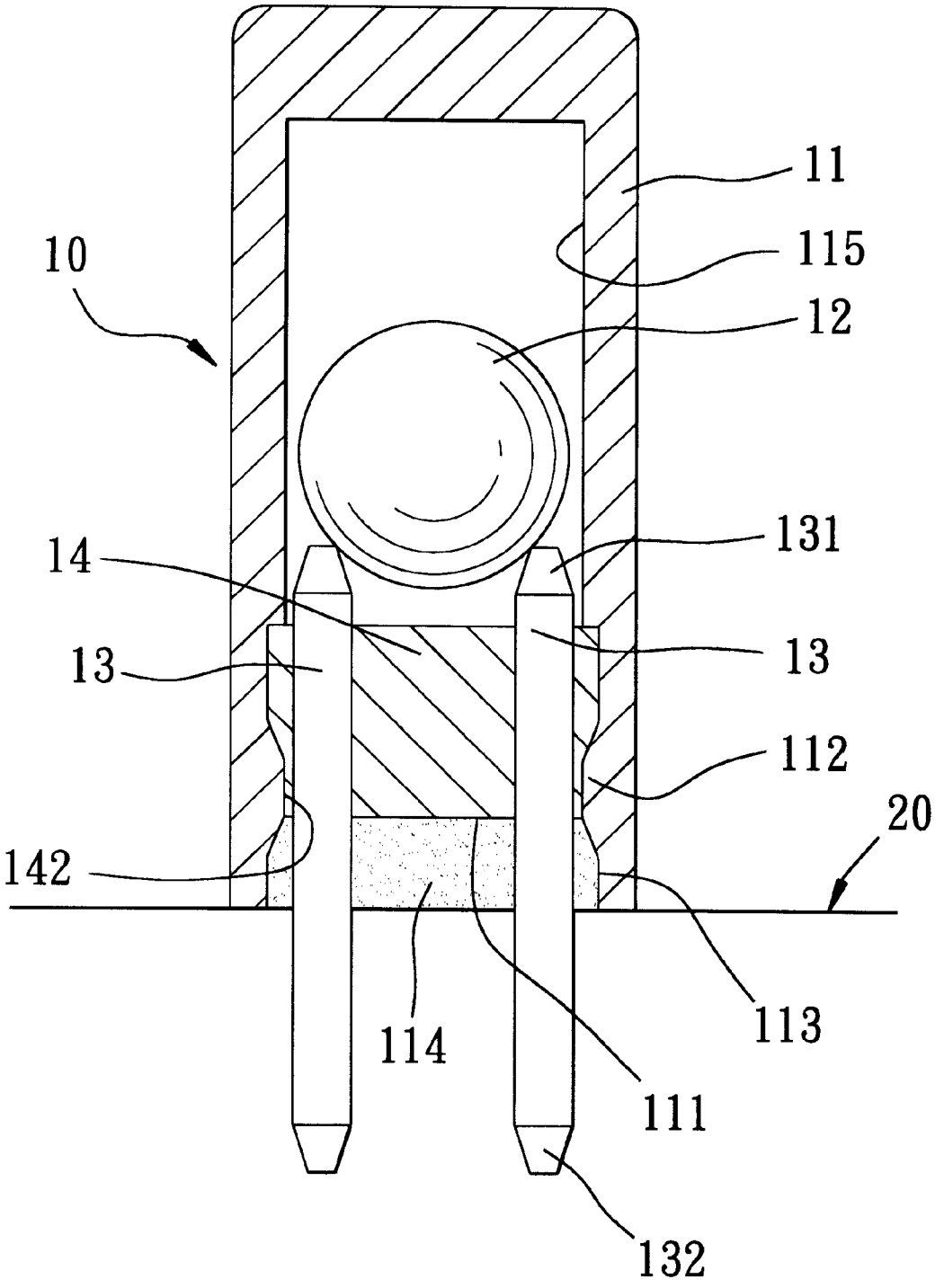
FIG. 2 PRIOR ART
FIG. 2 is a sectional view of the conventional tilt switch.
Figure 3:
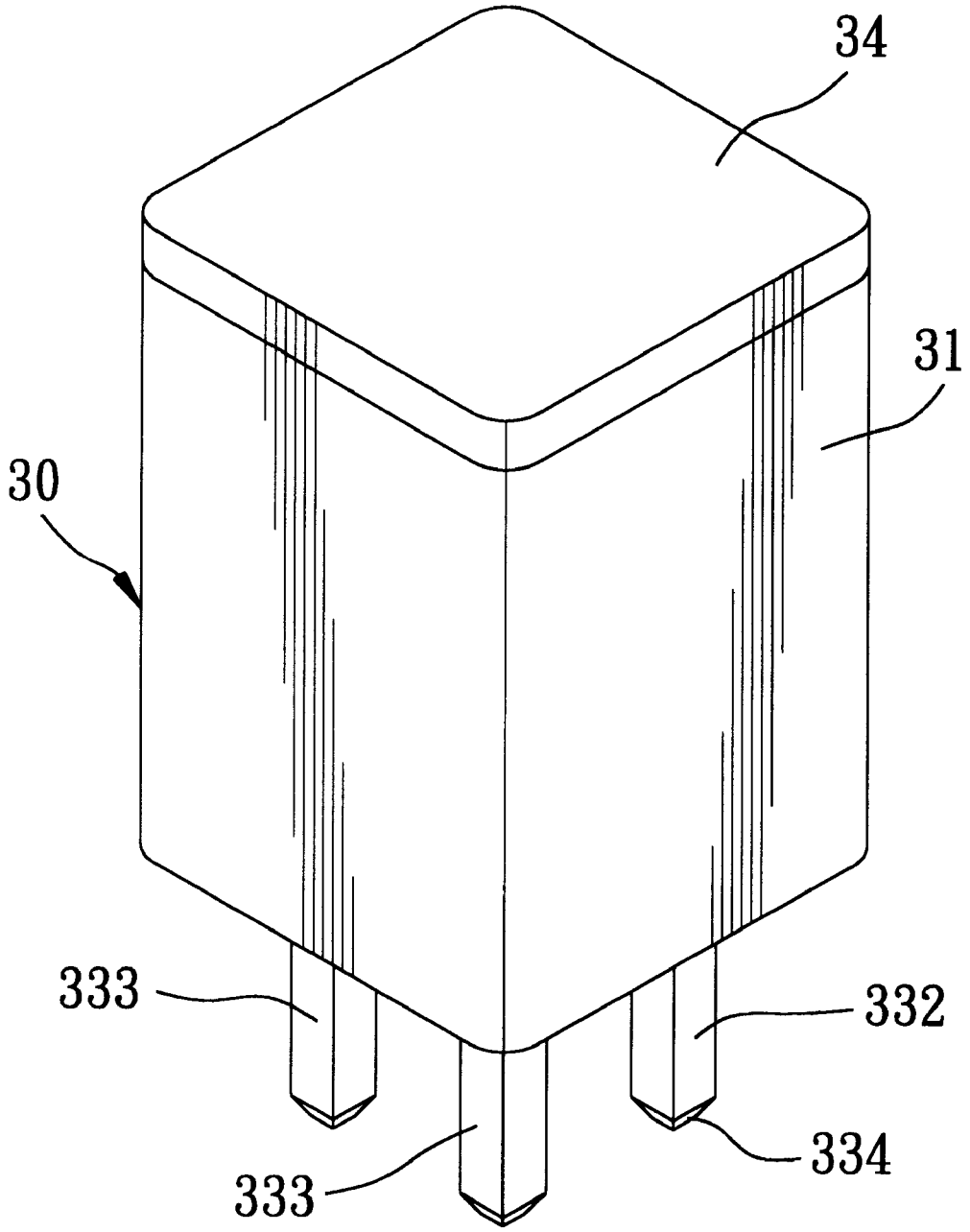
FIG. 3 is a perspective view of a preferred embodiment of a tilt switch according to this invention.
Figure 4:
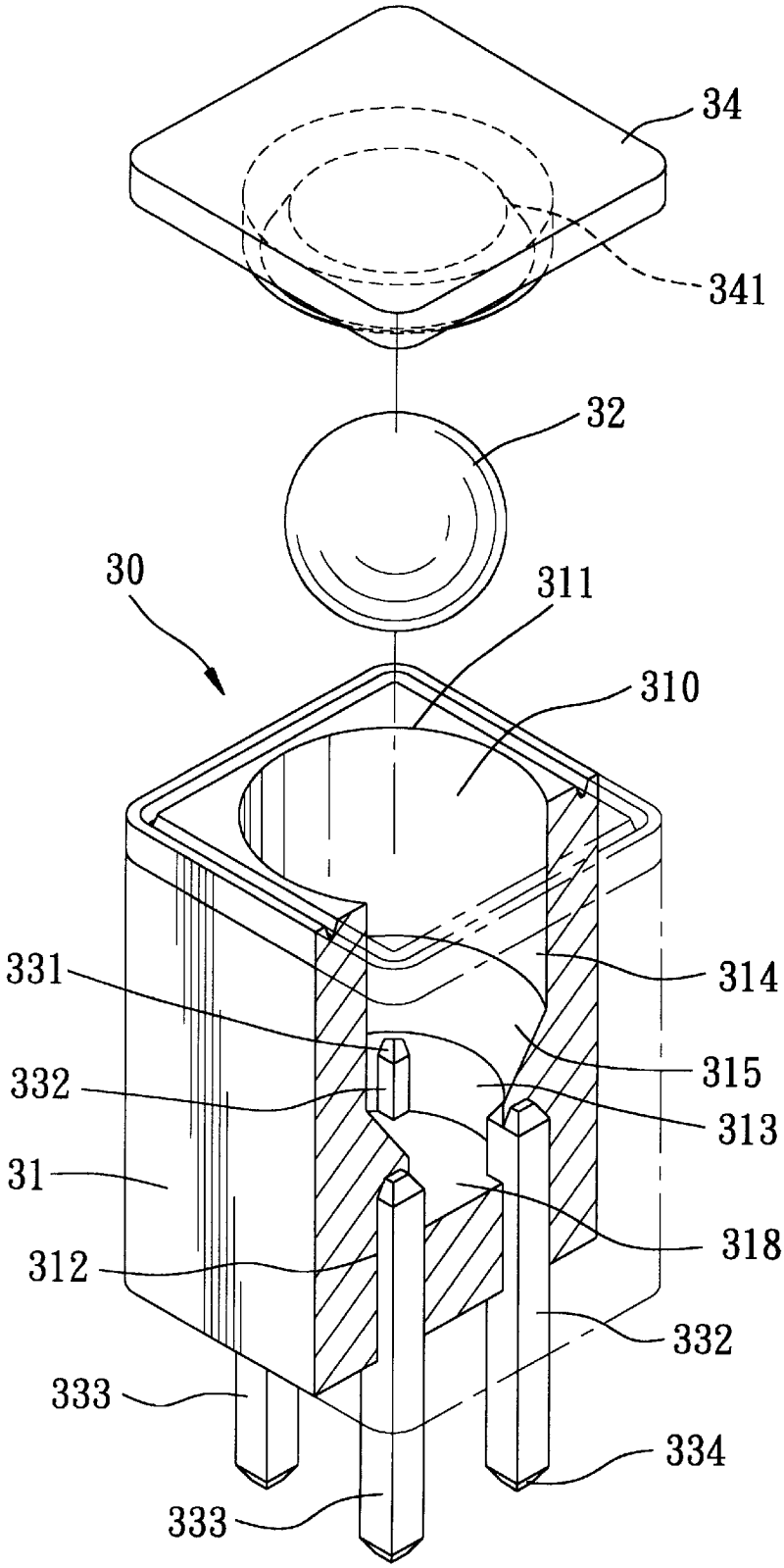
FIG. 4 is an exploded, partly cutaway perspective view of the preferred embodiment.

Referring to FIGS. 3, 4, 5 and 9, the preferred embodiment of the tilt switch 30 according to the present invention is shown to be adapted to be mounted on and to be in electric contact with a support (not shown), such as a circuit board, in an upright position. The tilt switch 30 is shown to comprise an insulating housing 31 which is adapted to be mounted on the support in an upright direction. The housing 31 has an inner bottom wall surface 318, and an inner peripheral wall surface which extends upwardly from a periphery of the inner bottom wall surface 318 and which confines an accommodating chamber 310 therein. The inner peripheral wall surface includes a lower segment 313 which is proximate to the periphery of the inner bottom wall surface 318 and which defines a first diameter, an upper segment 314 which is disposed opposite to the lower segment 313 in the upright direction and which defines a second diameter larger than the first diameter, and an annular shoulder segment 315 which extends between and which interconnects the upper and lower segments 314,313 so as to define an annular juncture 319 between the lower and shoulder segments 313,315. The annular juncture 319 is located at a horizontal plane 60. The shoulder segment 315 flares from the annular juncture 319 toward the upper segment 314 to define a first slope relative to the horizontal plane 60. In this embodiment, the first slope is at least 0.5, that is 45 degrees or more relative to the horizontal plane 60. Two pairs of through holes 312 are formed in the housing 31 in the upright direction to pass through the inner bottom wall surface 318, and are spaced apart from each other in a transverse direction relative to the upright direction.

Two pairs of first and second electric contact terminals 332,333 are press-fitted in the through holes 312 respectively at middle portions thereof. Each of the first and second electric contact terminals 332,333 has an upper end portion which extends upwardly from the middle portion into the accommodation chamber 310 to form a contact surface 331 spaced apart from the bottom wall surface 318, and a lower end portion 334 which extends downwardly from the middle portion and outwardly of the housing 31 and which is adapted to establish electrical connection with the support. The contact surfaces 331 incline gradually and upwardly to define a second slope which is substantially the same as the first slope of the shoulder segment 315.

Figure 5:
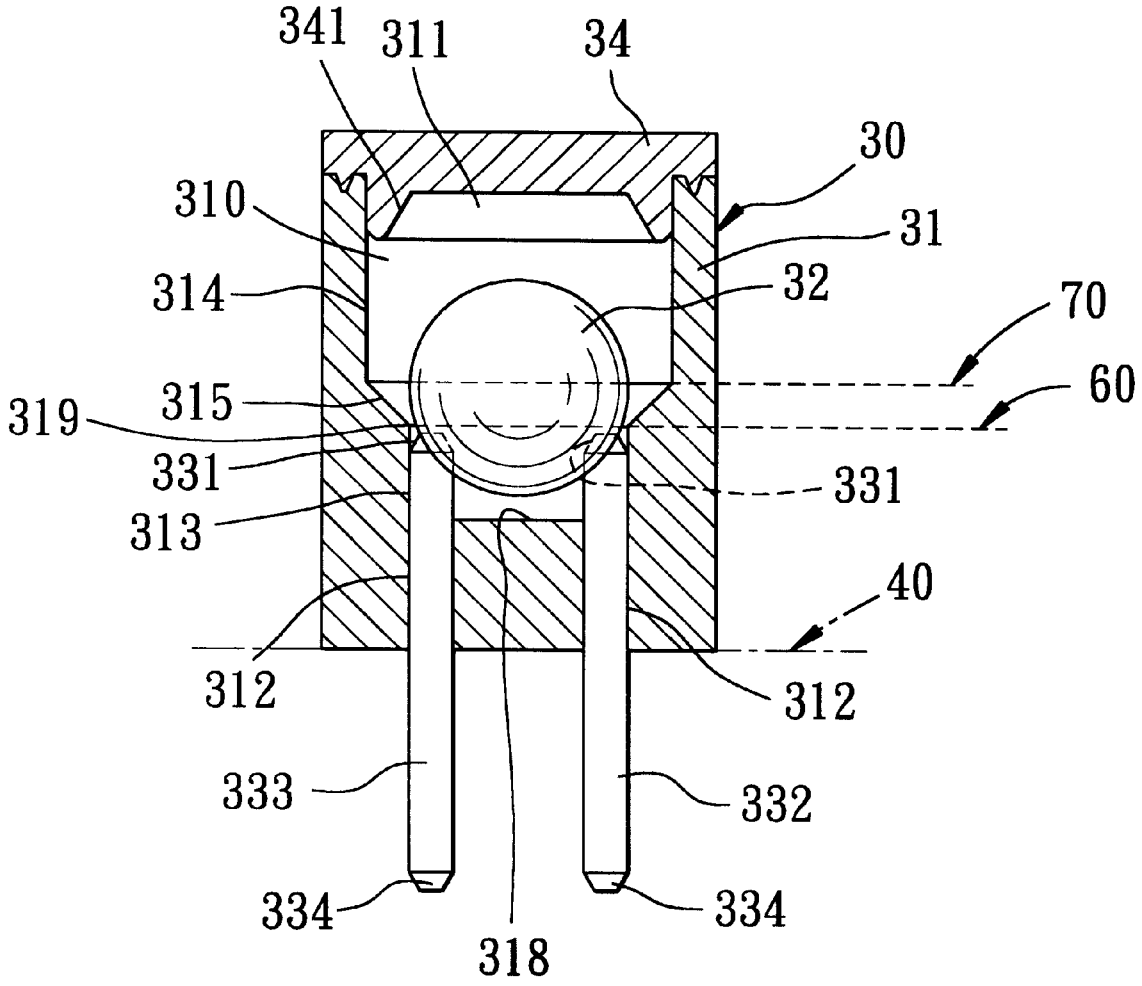
FIGS. 5 to 8 are sectional views illustrating the preferred embodiment from an upright state to a tilted state.
Figure 6:
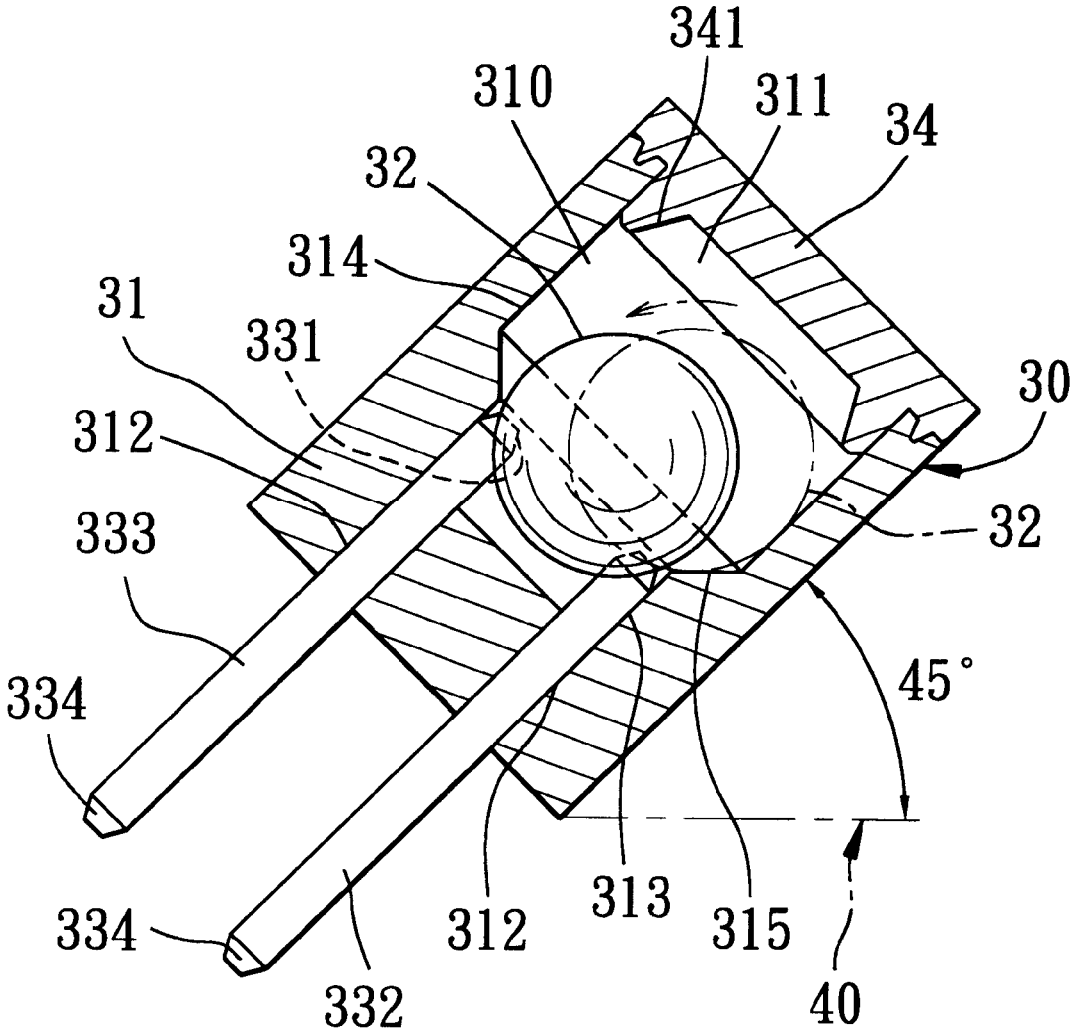
Figure 7:
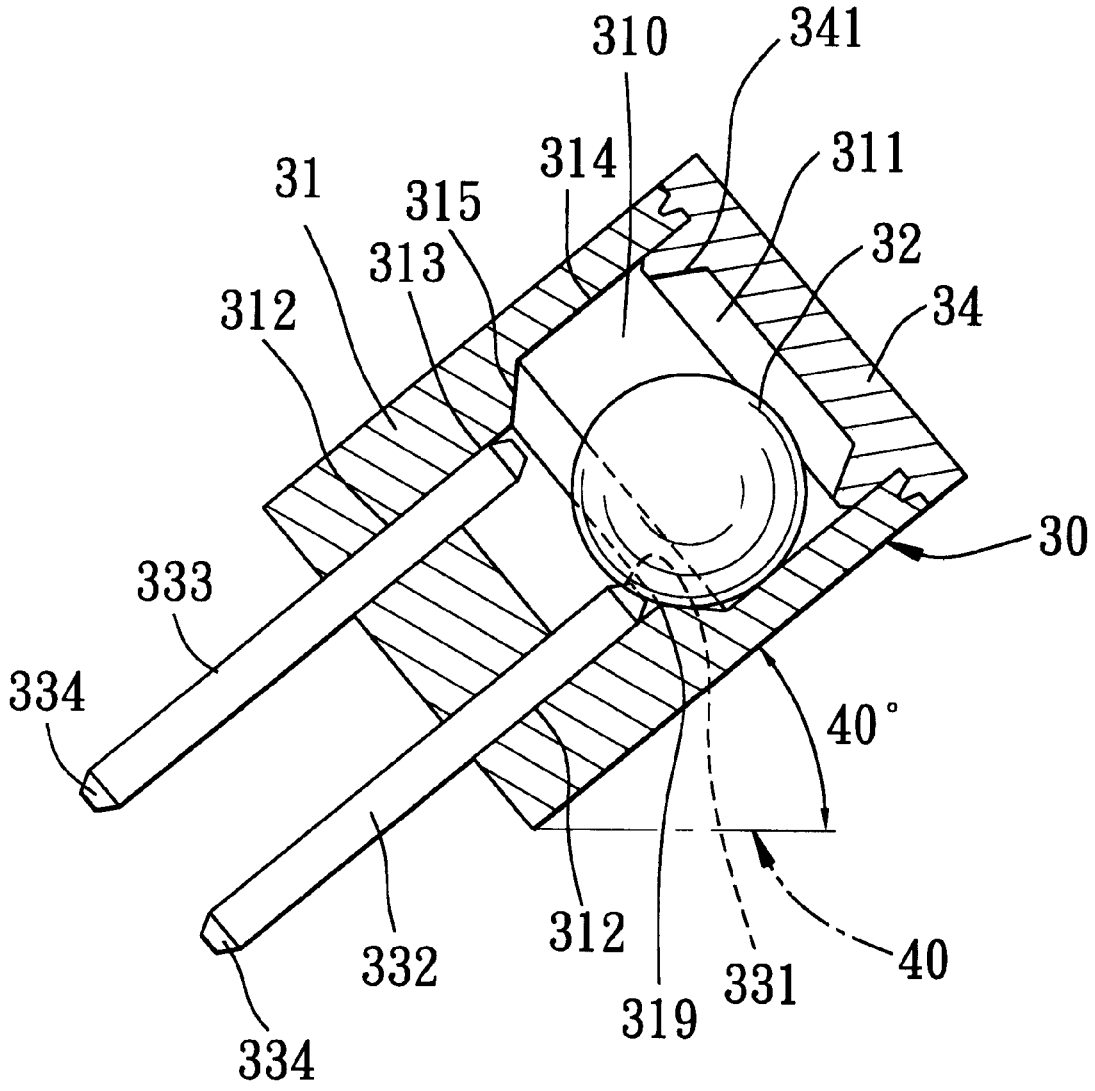
Figure 8:
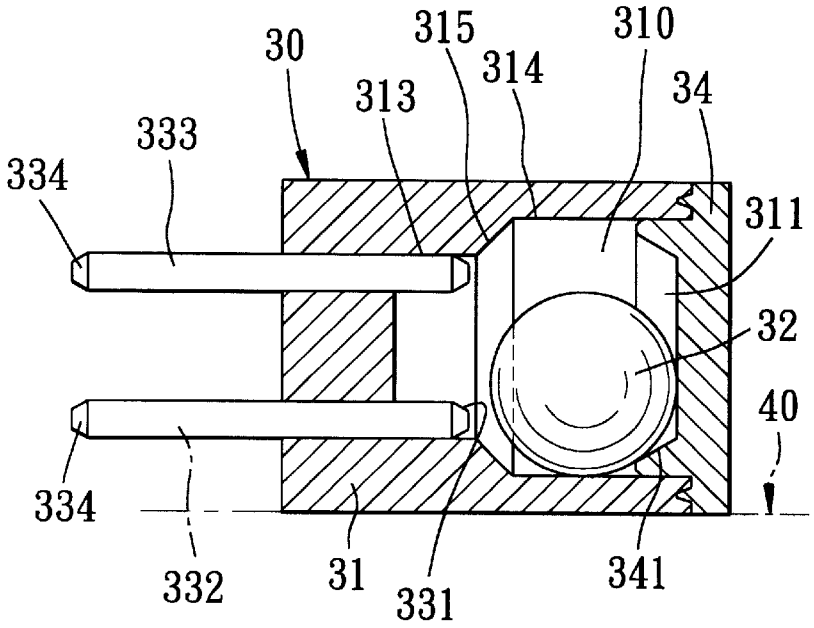
Figure 9:
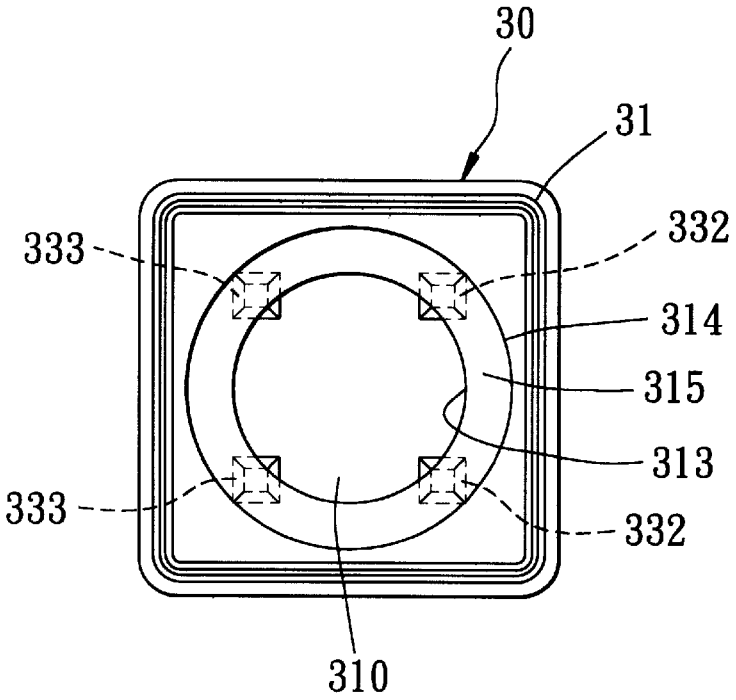
FIG. 9 is a top view of a portion of the preferred embodiment.

An electrically conductive ball 32 is received rollably in the accommodation chamber 32, and defines a horizontal plane 70 at which a center of the ball 32 is located. As shown in FIG. 5, when the housing 31, as well as the support, stands on a horizontal plane 40 in an upright position, the ball 32 contacts the contact surfaces 331 so as to make an electrical connection between the first and second electric contact terminals 332,333. At this time, the horizontal plane 70 is higher than the horizontal plane 60 at which the juncture 319 is located. Thus, as shown in FIG. 6, once the housing 31 is tilted from the upright position to a predetermined angle, such as about 45 degrees, the ball 32 maintains contact with the contact surfaces 331 to keep the electrical connection between the terminals 332,333. Then, referring to FIGS. 7 and 8, once the housing 31 is further tilted down to more than the predetermined angle, by means of the inclination of the contact surfaces 331 and the shoulder segment 315, the ball 32 will roll smoothly over the annular juncture 319 to the shoulder segment 315 so as to break the electrical connection between the terminals 332,333. As illustrated, the tilt switch 30 according to this invention can be used with an electrical contact member (not shown) of the support applied on an uprightly standing appliance, such as a stand light, fan, heater, etc., and can provide adequate protection to the appliance.

Preferably, an insulating cap member 34 is secured on an upper opening 311 confined by the upper segment 314 to prevent movement of the ball 32 out of the accommodation chamber 310 in the upright direction without hindering the rolling of the ball 32 in the accommodation chamber 310. The cap member 34 has an arcuate inner wall surface 341.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A tilt switch adapted to be mounted on and to be in electric contact with a support in an upright position, said tilt switch comprising:

an insulating housing adapted to be mounted on the support in an upright direction, and having an inner bottom wall surface, and an inner peripheral wall surface which extends upwardly from a periphery of said inner bottom wall surface and which confines an accommodating chamber therein, said inner peripheral wall surface including a lower segment which is proximate to said periphery of said inner bottom wall surface and which defines a first diameter, an upper segment which is disposed opposite to said lower segment in the upright direction and which defines a second diameter larger than the first diameter, and an annular shoulder segment which extends between and which interconnects said upper and lower segments so as to define an annular juncture between said lower and shoulder segments;

first and second electric contact terminals, each including a middle portion which is secured in said housing, an upper end portion extending upwardly from said middle portion into said accommodation chamber through said inner bottom wall surface to form a contact surface spaced apart from said bottom wall surface, and a lower end portion extending downwardly from said middle portion and outwardly of said housing and adapted to establish electrical connection with the support, said contact surfaces of said first and second electric contact terminals being spaced apart from each other in a transverse direction relative to the upright direction; and an electrically conductive ball received rollably in said accommodation chamber, and of such a dimension as to contact said contact surfaces when said housing stands in the upright position, thereby making an electrical connection between said first and second electric contact terminals, said ball defining a first horizontal plane at which a center of said ball is located;

said annular juncture being located at a second horizontal plane lower than the first horizontal plane such that once said housing is tilted from the upright position, said ball will move over said annular juncture to said shoulder segment so as to break the electrical connection between said first and second electric contact terminals.

2. The tilt switch of claim 1, wherein said shoulder segment flares from said annular juncture toward said upper segment to define a first slope relative to the second horizontal plane.

3. The tilt switch of claim 2, wherein said contact surface of each of said first and second electric contact terminals inclines gradually and upwardly to define a second slope which is substantially the same as the first slope.

4. The tilt switch of claim 3, wherein said first slope is 0.5.

5. The tilt switch of claim 1, further comprising an insulating cap member disposed on said upper segment to prevent movement of said ball out of said accommodation chamber in the upright direction.

* * * * *